US006125474A

United States Patent [19]

Gillette

[11] Patent Number: 6,125,474

[45] Date of Patent: Oct. 3, 2000

[54] WATER HAT

[76] Inventor: William A. Gillette, 33 Greenfield St., Poughkeepsie, N.Y. 12603

[21] Appl. No.: 09/373,202

[22] Filed: Aug. 12, 1999

[51] Int. Cl.[7] ..... A42B 1/04

[52] U.S. Cl. ..... 2/171.2; 2/7; 2/195.1; 607/110

[58] Field of Search ..... 2/171.2, 7, 181, 2/181.4, 209.13, 195.1, 182.3, 209.14, 181.6, 182.2, 182.1; 607/109, 110; 62/259.3

[56] References Cited

U.S. PATENT DOCUMENTS

| | | | |
|---|---|---|---|
| 35,707 | 6/1862 | Richards | 2/7 |
| 340,793 | 4/1886 | Leonard | 2/7 |
| 770,031 | 9/1904 | Werrick | 607/110 |
| 2,763,308 | 11/1956 | Krasno | 2/171.2 |
| 3,070,803 | 1/1963 | Slepicka | 2/7 |
| 3,766,565 | 10/1973 | Cozzens | 2/195.1 |
| 4,484,363 | 11/1984 | Varanese | 2/209.13 |
| 5,197,292 | 3/1993 | McPherson | 2/7 |
| 5,365,607 | 11/1994 | Benevento, Jr. et al. | 2/181.4 |
| 5,469,579 | 11/1995 | Tremblay et al. | 607/110 |
| 5,557,807 | 9/1996 | Hujar et al. | 2/209.11 |

*Primary Examiner*—Amy B. Vanatta

[57] ABSTRACT

A water-cooled baseball cap is provided including a cap portion with a hemi-spherical configuration having a circular open bottom and a dome-shaped top. The cap portion includes a plurality of layers thereby defining an interior space. A bladder includes an upper layer and a lower layer both constructed from an elastomeric material. Such layers both define a hemi-spherical configuration having a circular open bottom and a dome-shaped top. The layers of the bladder are integrally coupled at bottom peripheral edges thereof thus defining a thin uniform spherical interior space. The bladder is situated within the interior space of the cap. The lower layer of the bladder has a plurality of minuscule apertures formed therein for allowing water situated within the bladder to flow onto the head of the user. A visor is mounted to bottom peripheral edges of the cap portion and extend radially outwardly therefrom for precluding light rays from shining on a face of the user.

8 Claims, 2 Drawing Sheets

WATER HAT

BACKGROUND OF THE INVENTION

1. Field of the Invention

The present invention relates to liquid cooled head gear and more particularly pertains to a new water hat for cooling a head of a user with a fashionable water cooled baseball cap.

2. Description of the Prior Art

The use of liquid cooled head gear is known in the prior art. More specifically, liquid cooled head gear heretofore devised and utilized are known to consist basically of familiar, expected and obvious structural configurations, notwithstanding the myriad of designs encompassed by the crowded prior art which have been developed for the fulfillment of countless objectives and requirements.

Known prior art liquid cooled head gear include U.S. Pat. Nos. 5,365,607; 5,197,292; 4,575,871; 4,425,917; 4,551,858; and 4,138,743.

In these respects, the water hat according to the present invention substantially departs from the conventional concepts and designs of the prior art, and in so doing provides an apparatus primarily developed for the purpose of cooling a head of a user with a fashionable water cooled baseball cap.

SUMMARY OF THE INVENTION

In view of the foregoing disadvantages inherent in the known types of liquid cooled head gear now present in the prior art, the present invention provides a new water hat construction wherein the same can be utilized for cooling a head of a user with a fashionable water cooled baseball cap.

The general purpose of the present invention, which will be described subsequently in greater detail, is to provide a new water hat apparatus and method which has many of the advantages of the liquid cooled head gear mentioned heretofore and many novel features that result in a new water hat which is not anticipated, rendered obvious, suggested, or even implied by any of the prior art liquid cooled head gear, either alone or in any combination thereof.

To attain this, the present invention generally comprises a cap portion having a hemi-spherical configuration defined by a circular open bottom and a dome-shaped top. As best shown in FIG. 3, the cap portion includes an inner cloth lining layer which is pervious to water. Associated therewith is an outer insulative layer with an inner surface including a woven fabric. An outer surface of the outer insulative layer includes a reflective material such as a thin flexible metallic material. A bottom peripheral edge of the inner cloth lining layer is coupled to that of the outer insulative layer thus defining an interior space. The cap portion further includes a thin rectangular elastic band mounted within the interior space. The band is positioned adjacent the bottom peripheral edges of the cap portion for securing the cap to a head of a user when worn. With reference to FIG. 3, it is shown that a bladder is provided including an upper layer and a lower layer both constructed from an elastomeric material. Similar to the cap, each layer of the bladder is constructed with a hemi-spherical configuration having a circular open bottom and a dome-shaped top. The layers of the bladder are integrally coupled at bottom peripheral edges thereof thus defining a spherical interior space that is both thin and of a uniform thickness. The bladder is situated within the interior space of the cap such that the bottom peripheral edges of the bladder rest on a top edge of the elastic band adjacent to the bottom peripheral edges of the cap portion. It should be noted that the lower layer of the bladder has a plurality of minuscule apertures formed therein for allowing water situated within the bladder to flow onto the head of the user. Next provided is a cover being selectively coupled about apertures formed in the outer layer of the cap portion and upper layer of the bladder at apexes thereof. The cover thus functions to allow a user to fill the bladder with water as necessary. Finally, an arcuate resilient visor is mounted to the bottom peripheral edges of the cap portion and extends radially outwardly therefrom. During use, the visor serves for precluding light rays from shining on a face of the user.

There has thus been outlined, rather broadly, the more important features of the invention in order that the detailed description thereof that follows ma) be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water hat apparatus and method which has many of the advantages of the liquid cooled head gear mentioned heretofore and many novel features that result in a new water hat which is not anticipated, rendered obvious, suggested, or even implied by any of the prior art liquid cooled head gear, either alone or in any combination thereof.

It is another object of the present invention to provide a new water hat which may be easily and efficiently manufactured and marketed.

It is a further object of the present invention to provide a new water hat which is of a durable and reliable construction.

An even further object of the present invention is to provide a new water hat which is susceptible of a low cost of manufacture with regard to both materials and labor, and which accordingly is then susceptible of low prices of sale to the consuming public, thereby making such water hat economically available to the buying public.

Still yet another object of the present invention is to provide a new water hat which provides in the apparatuses and methods of the prior art some of the advantages thereof, while simultaneously overcoming some of the disadvantages normally associated therewith.

Still another object of the present invention is to provide a new water hat for cooling a head of a user with a fashionable water cooled baseball cap.

Even still another object of the present invention is to provide a new water hat that includes a cap portion with a hemi-spherical configuration having a circular open bottom and a dome-shaped top. The cap portion includes a plurality of layers thereby defining an interior space. A bladder includes an upper layer and a lower layer both constructed from an elastomeric material. Such layers both define a hemispherical configuration having a circular open bottom and a dome-shaped top. The layers of the bladder are integrally coupled at bottom peripheral edges thereof thus defining a thin uniform spherical interior space. The bladder is situated within the interior space of the cap. The lower layer of the bladder has a plurality of minuscule apertures formed therein for allowing water situated within the bladder to flow onto the head of the user. A visor is mounted to bottom peripheral edges of the cap portion and extend radially outwardly therefrom for precluding light rays from shining on a face of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
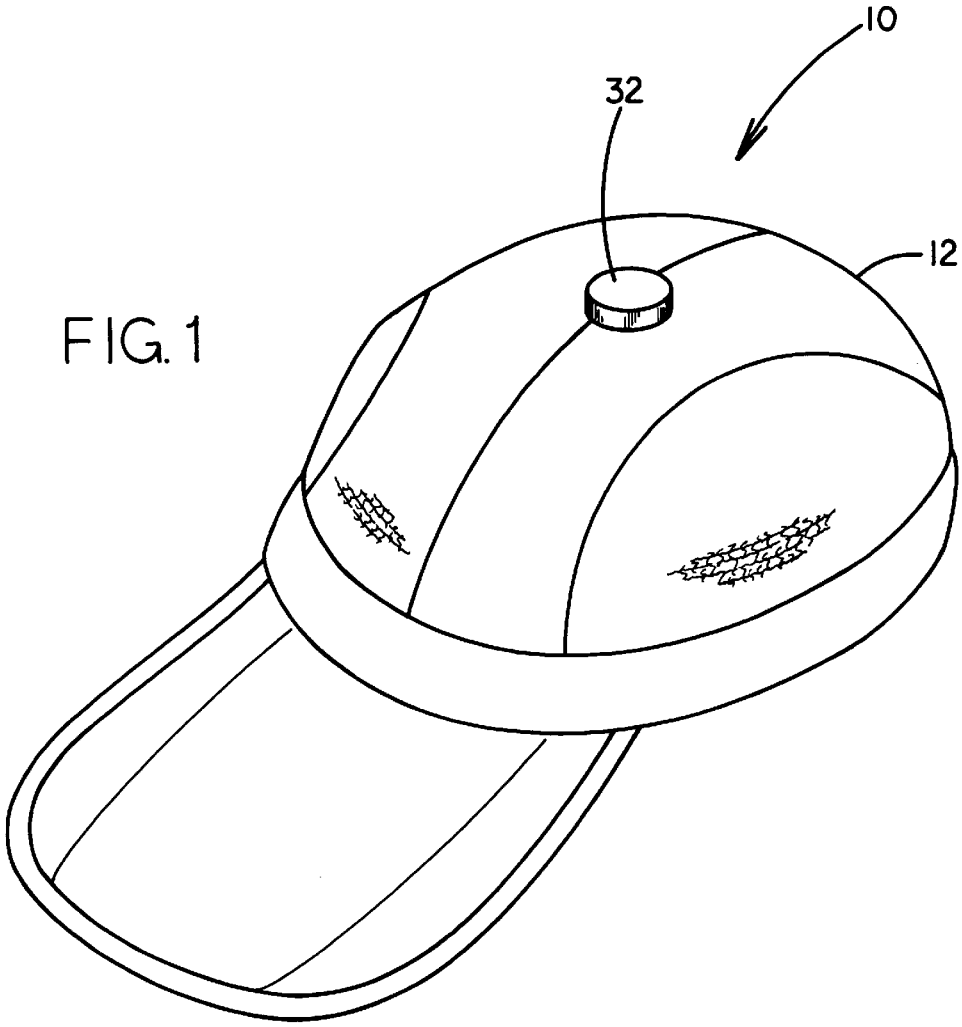
FIG. 1 is a perspective view of a new water hat according to the present invention.
Figure 2:
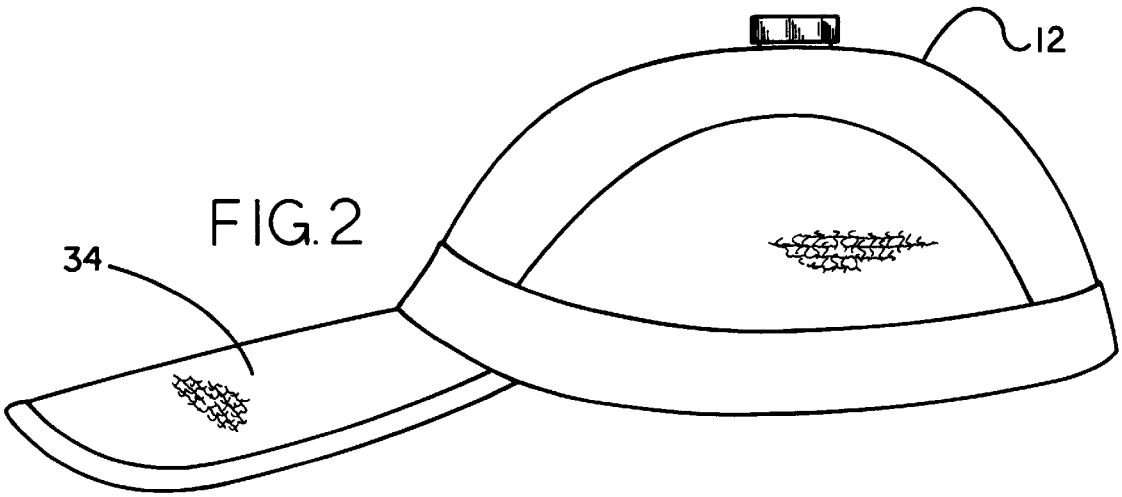
FIG. 2 is a side view of the present invention.

With reference now to the drawings, and in particular to FIGS. 1 through 4 thereof, a new water hat embodying the principles and concepts of the present invention and generally designated by the reference numeral 10 will be described.

Figure 3:
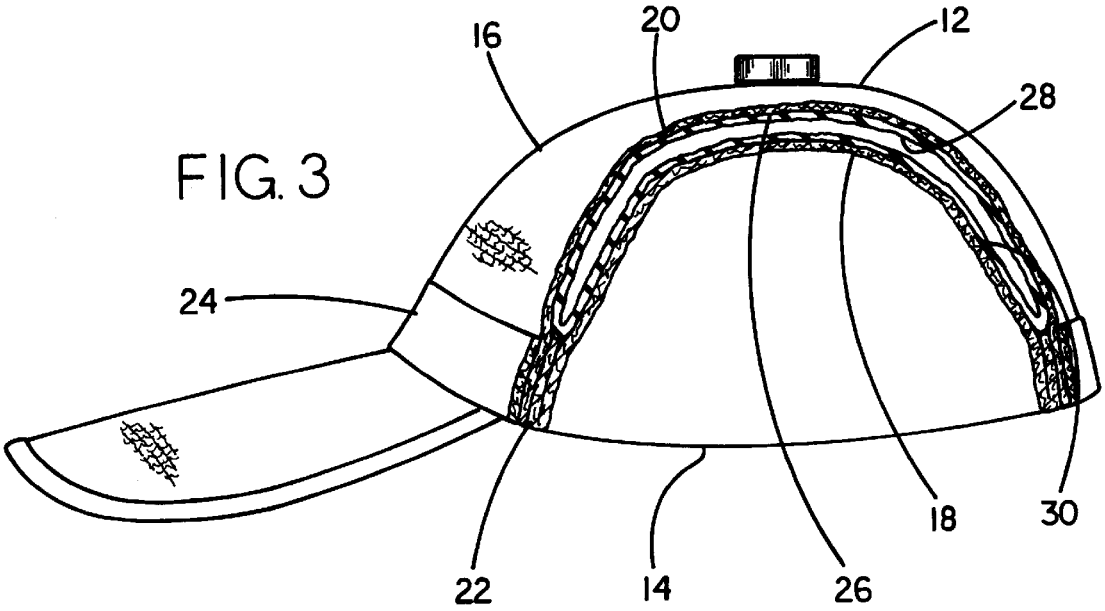
FIG. 3 is a side cross-sectional view of the present invention.

The present invention, as designated as numeral 10, includes a cap portion 12 having a hemispherical configuration defined by a circular open bottom 14 and a dome-shaped top 16. As best shown in FIG. 3, the cap portion includes an inner cloth 18 lining layer which is pervious to water. Associated therewith is a closed outer insulative layer 20 with an inner surface including a woven fabric. An outer surface of the outer insulative layer includes a reflective material. A bottom peripheral edge of the inner cloth lining layer is coupled to that of the outer insulative layer thus defining an interior space.

The cap portion further includes a thin rectangular elastic band 22 mounted within the interior space. The band is positioned adjacent the bottom peripheral edges of the cap portion for securing the cap to a head of a user when worn. As an option, a second band 24 may be mounted to an outer surface of the cap portion for rendering robust elasticity.

With reference to FIG. 3, it is shown that a bladder 26 is provided including an upper layer 28 and a lower layer 30 both constructed from an elastomeric material. Similar to the cap, each layer of the bladder is constructed with a hemi-spherical configuration having a circular open bottom and a dome-shaped top. The layers of the bladder are integrally coupled at bottom peripheral edges thereof thus defining a spherical interior space that is both thin and of a uniform thickness.

The bladder is situated within the interior space of the cap such that the bottom peripheral edges of the bladder rest on a top edge of the elastic band adjacent to the bottom peripheral edges of the cap portion. It should be noted that the lower layer of the bladder has a plurality of minuscule apertures formed therein for allowing water situated within the bladder to flow onto the head of the user. In alternate embodiments, the bladder and layers of the cap portion may be pleated to more readily resemble a baseball cap.

Next provided is a cover 32 being selectively coupled about apertures formed in the outer layer of the cap portion and upper layer of the bladder at apexes thereof. Such coupling is preferably accomplished by way of a threaded sleeve mounted to the upper layer of the bladder and extending upwardly through the cap portion. The cover has complementary threads formed on an interior surface thereof. The cover thus functions to allow a user to fill the bladder with water as necessary.

Figure 4:
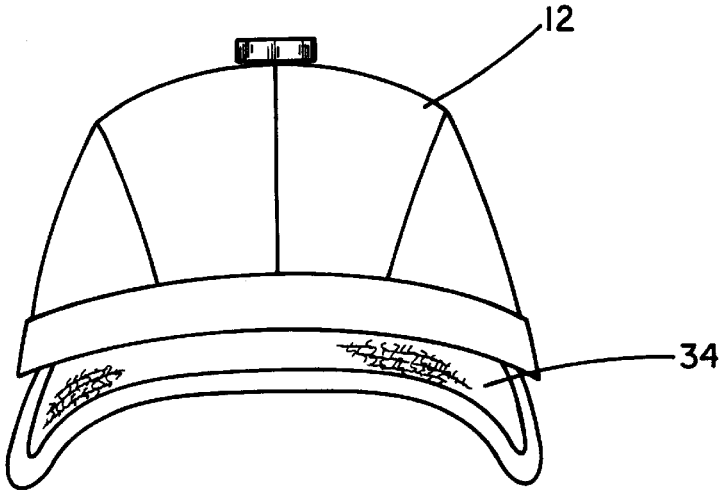
FIG. 4 is a front view of the present invention.

Finally, an arcuate resilient visor 34 is mounted to the bottom peripheral edges of the cap portion and extends radially outwardly therefrom. As best shown in FIG. 4, sides of the visor are crested. During use, the visor serves for precluding light rays from shining on a face of the user. As an option, an upper surface of the visor may be equipped with the reflective material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water-cooled baseball cap comprising, in combination:

a cap portion including a hemispherical configuration having a circular open bottom and a dome-shaped top, the cap portion including an inner cloth lining layer which is pervious to water and an outer insulative layer with an inner surface including a woven fabric and an outer surface including a reflective material with a bottom peripheral edge of the inner cloth lining layer coupled to that of the outer insulative layer thereby defining an interior space, the cap portion further including a thin rectangular elastic band mounted within the interior space adjacent to the bottom peripheral edges of the cap portion for securing the cap to a head of a user when worn;

a bladder including an upper layer and a lower layer both constructed from an elastomeric material with a hemi-spherical configuration having a circular open bottom and a dome-shaped top, the layers of the bladder being integrally coupled at bottom peripheral edges thereof thus defining a thin uniform spherical interior space, the bladder situated within the interior space of the cap such that the bottom peripheral edges of the bladder rest on a top edge of the elastic band adjacent to the bottom peripheral edges of the cap portion, the lower layer of the bladder having a plurality of minuscule apertures formed therein for allowing water situated within the bladder to flow onto the head of the user;

a cover being selectively coupled about apertures formed in the outer layer of the cap portion and upper layer of the bladder at apexes thereof thereby allowing a user to fill the bladder with water as necessary; and an arcuate resilient visor mounted to the bottom peripheral edges of the cap portion and extending radially outwardly therefrom for precluding light rays from shining on a face of the user.

2. A water-cooled baseball cap comprising:

a cap portion including a hemi-spherical configuration having a circular open bottom and a dome-shaped top, the cap portion including at least one layer thereby defining an interior space;

a bladder including an upper layer and a lower layer both constructed from an elastomeric material with a hemi-spherical configuration having a circular open bottom and a dome-shaped top, the layers of the bladder being integrally coupled at bottom peripheral edges thereof thus defining a thin uniform spherical interior space, the bladder situated within the interior space of the cap, the lower layer of the bladder having a plurality of minuscule apertures formed therein for allowing water situated within the bladder to flow onto the head of the user; and a visor mounted to bottom peripheral edges of the cap portion and extending radially outwardly therefrom for precluding light rays from shining on a face of the user.

3. A water-cooled baseball cap as set forth in claim 2 wherein the bladder is situated within the interior space of the cap such that the bottom peripheral edges of the bladder rest on a top edge of an elastic band situated adjacent to the bottom peripheral edges of the cap portion.

4. A water-cooled baseball cap as set forth in claim 2 and further including a cover for being selectively coupled about apertures formed in the cap portion and the bladder at apexes thereof thereby allowing a user to fill the bladder with water as necessary.

5. A water-cooled baseball cap as set forth in claim 4 wherein the cap is situated at an apex of the cap portion.

6. A water-cooled baseball cap as set forth in claim 2 wherein the layers of the cap portion include an inner cloth lining layer which is pervious to water.

7. A water-cooled baseball cap as set forth in claim 2 wherein the layers of the cap portion include an outer insulative layer with an inner surface including a woven fabric and an outer surface including a reflective material.

8. A water-cooled baseball cap as set forth in claim 2 wherein the cap portion further includes a thin rectangular elastic band mounted within the interior space adjacent to the bottom peripheral edges of the cap portion for securing the cap to a head of a user when worn.

* * * * *